US010611157B2

(12) United States Patent
Asano et al.

(10) Patent No.: US 10,611,157 B2
(45) Date of Patent: Apr. 7, 2020

(54) WIPING DEVICE, HEAD MAINTENANCE DEVICE, AND LIQUID DISCHARGE APPARATUS

(71) Applicants: Yukihiro Asano, Kanagawa (JP); Tatsuroh Watanabe, Kanagawa (JP); Daisuke Hasebe, Kanagawa (JP); Kenta Takahashi, Kanagawa (JP)

(72) Inventors: Yukihiro Asano, Kanagawa (JP); Tatsuroh Watanabe, Kanagawa (JP); Daisuke Hasebe, Kanagawa (JP); Kenta Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/247,618

(22) Filed: Jan. 15, 2019

(65) Prior Publication Data

US 2019/0255854 A1 Aug. 22, 2019

(30) Foreign Application Priority Data

Feb. 22, 2018 (JP) ..... 2018-029699

(51) Int. Cl.
*B41J 2/165* (2006.01)

(52) U.S. Cl.
CPC ..... *B41J 2/16538* (2013.01); *B41J 2/16535* (2013.01); *B41J 2/16541* (2013.01);
(Continued)

(58) Field of Classification Search
CPC ..... B41J 2002/1655
See application file for complete search history.

(56) References Cited

U.S. PATENT DOCUMENTS 10,457,052 B2 * 10/2019 Tsubaki ..... B41J 2/16538
2012/0038707 A1 * 2/2012 Maida ..... B41J 2/16541
347/33

(Continued)

FOREIGN PATENT DOCUMENTS

JP 2003-025596 1/2003
JP 2006205712 A * 8/2006 ..... B41J 2/16535

(Continued)

OTHER PUBLICATIONS

Extended European Search Report dated Jun. 26, 2019 in Patent Application No. 19156659.5, citing documents AA-AD therein, 8 pages.

*Primary Examiner* — Julian D Huffman
(74) *Attorney, Agent, or Firm* — Oblon, McClelland, Maier & Neustadt, L.L.P.

(57) ABSTRACT

A wiping device includes a wiping member including a web to wipe an object to be wiped, and circuitry to cause the wiping member to perform a wiping operation to wipe the object to be wiped. The circuitry causes the wiping member to perform a first wiping operation to move the wiping member relative to the object to be wiped in a first direction to wipe the object to be wiped from a wiping start side of the first wiping operation, and perform a second wiping operation to relatively move the wiping member relative to the object to be wiped in a second direction different from the first direction, to wipe the object to be wiped from a wiping finish side different from the wiping start side of the first wiping operation with the wiping member.

10 Claims, 11 Drawing Sheets

(52) U.S. Cl.
CPC .... *B41J 2/16544* (2013.01); *B41J 2002/1655* (2013.01); *B41J 2002/16502* (2013.01); *B41J 2002/16558* (2013.01)

(56) References Cited

U.S. PATENT DOCUMENTS

| | | | | |
|---|---|---|---|---|
| 2013/0249998 | A1* | 9/2013 | Kasahara | B41J 2/16505 347/31 |
| 2014/0152742 | A1* | 6/2014 | Mizutani | B41J 2/16535 347/31 |
| 2015/0298475 | A1* | 10/2015 | Kuypers | B41J 2/16535 347/19 |
| 2016/0243836 | A1 | 8/2016 | Tanda | |
| 2017/0157935 | A1 | 6/2017 | Ohnishi | |
| 2017/0225471 | A1 | 8/2017 | Yamanobe | |
| 2017/0267879 | A1* | 9/2017 | Kohzuki | C09D 9/005 |
| 2017/0334209 | A1* | 11/2017 | Nakano | B41J 2/16538 |
| 2018/0126737 | A1 | 5/2018 | Asano | |
| 2018/0264822 | A1 | 9/2018 | Tanioku et al. | |
| 2019/0039379 | A1* | 2/2019 | Nakamura | B41J 2/16526 |
| 2019/0077158 | A1* | 3/2019 | Tsubaki | B41J 2/16535 |
| 2019/0184709 | A1* | 6/2019 | Hasebe | B41J 2/16535 |
| 2019/0270309 | A1* | 9/2019 | Nakagawa | B41J 2/16535 |

FOREIGN PATENT DOCUMENTS

| | | | | |
|---|---|---|---|---|
| JP | 2007-230033 | | 9/2007 | |
| JP | 2010-179631 | | 8/2010 | |
| JP | 2011-224971 | | 11/2011 | |
| JP | 2014-000704 | | 1/2014 | |
| JP | 2015-089658 | | 5/2015 | |
| JP | 2016-155279 | | 9/2016 | |
| WO | WO-2018231205 | A1 * | 12/2018 | B08B 1/005 |

* cited by examiner

WIPING DEVICE, HEAD MAINTENANCE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-029699, filed on Feb. 22, 2018, the entire disclosure of which is hereby incorporated by reference herein.

BACKGROUND

Technical Field

The present disclosure relates to a wiping device, a head maintenance device, and a liquid discharge apparatus.

Related Art

In a case where a liquid discharge head that discharges liquid is used, in order to maintain the state of a nozzle, provided is a maintenance mechanism (maintenance device) including a cap that caps a nozzle face and a wiping device that wipes and cleans the nozzle face.

A device including a blade-shaped wiper member that wipes a nozzle face, is known, in which a liquid discharge head moves relatively in a first direction with respect to the wiper member such that the nozzle face is wiped, then the liquid discharge head moves in a second direction such that the side face of the rear end in the wiping direction of the liquid discharge head is in contact with the wiper member, and then the liquid discharge head moves again in the first direction to be spaced apart from the wiper.

SUMMARY

In an aspect of this disclosure, a novel wiping device is provided in which the wiping device includes a wiping member including a web to wipe an object to be wiped, and circuitry to cause the wiping member to perform a wiping operation to wipe the object to be wiped. The circuitry causes the wiping member to perform a first wiping operation to move the wiping member relative to the object to be wiped in a first direction to wipe the object to be wiped from a wiping start side of the first wiping operation, and perform a second wiping operation to relatively move the wiping member relative to the object to be wiped in a second direction different from the first direction, to wipe the object to be wiped from a wiping finish side different from the wiping start side of the first wiping operation with the wiping member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
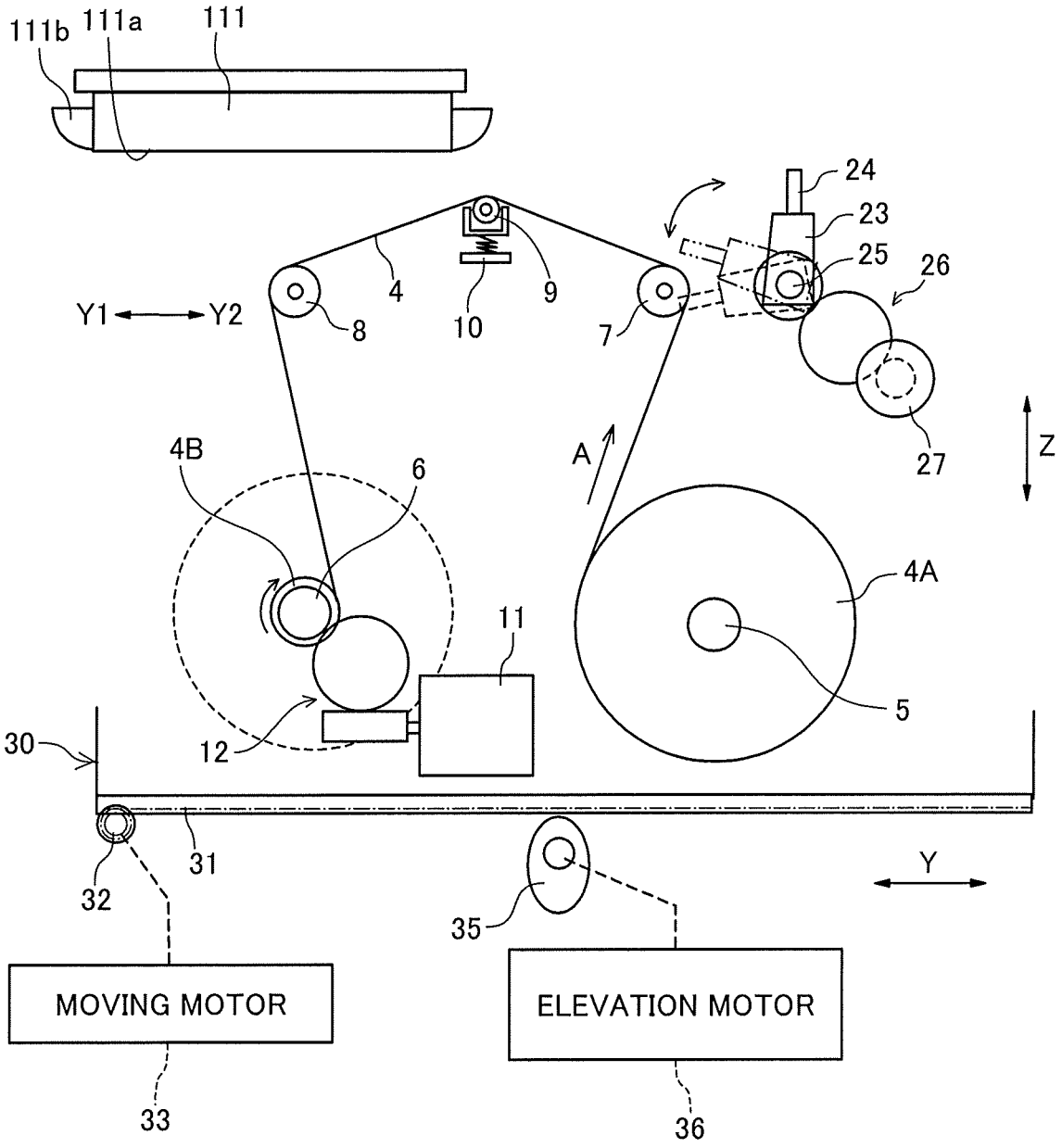
FIG. 1 is an explanatory side view of a wiping device according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
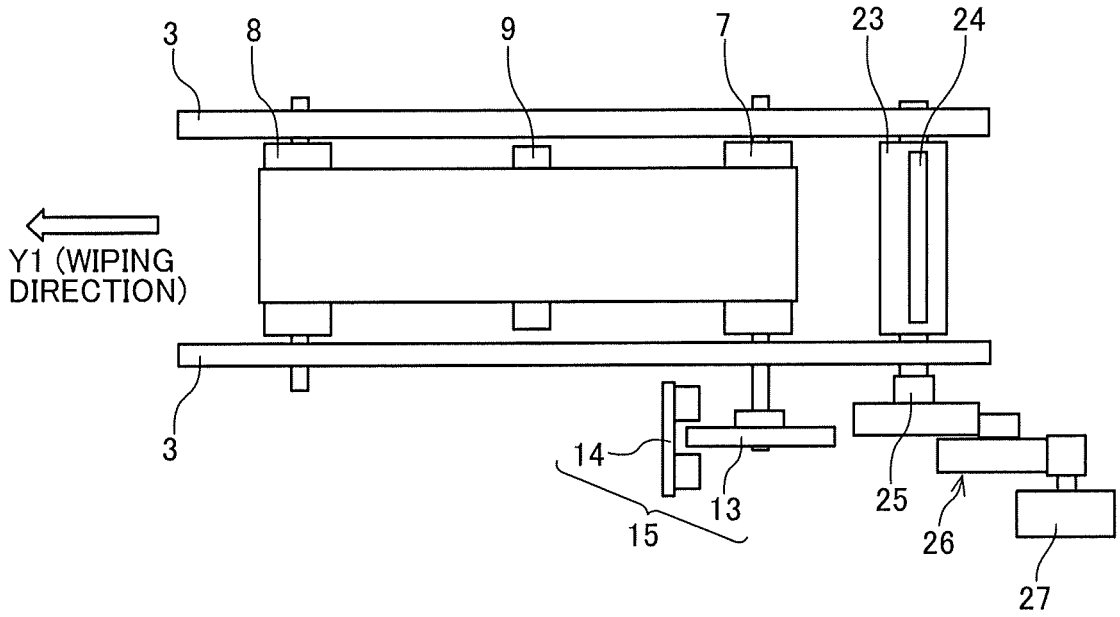
FIG. 2 is an explanatory plan view of the wiping device.
Figure 3:
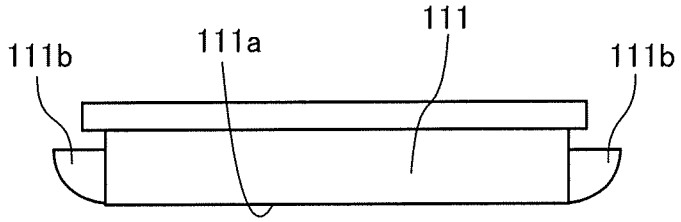
FIG. 3 is an explanatory side view of a liquid discharge head to be wiped by the wiping device.
Figure 4:
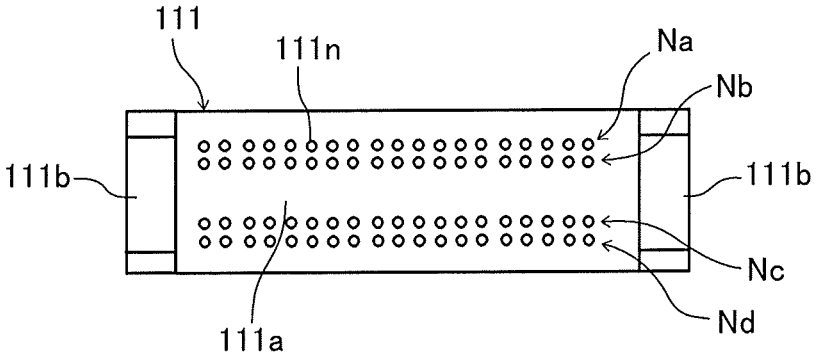
FIG. 4 is an explanatory plan view of the liquid discharge head when viewed from the nozzle face side.

An embodiment of the present disclosure will be described below referring to the accompanying drawings. A first embodiment of the present disclosure will be described referring to FIGS. 1 to 3. FIG. 1 is an explanatory side view of a wiping device according to the embodiment. FIG. 2 is an explanatory plan view of the wiping device. FIG. 3 is an explanatory side view of a liquid discharge head to be wiped by the wiping device. FIG. 4 is an explanatory plan view of the liquid discharge head when viewed from the nozzle face side.

In the present embodiment, an object to be wiped by a wiping device 1 includes a liquid discharge head 111 of a liquid discharge apparatus. Hereinafter, the "liquid discharge head" is also referred to as the "head".

As illustrated in FIGS. 3 and 4, the head 111 has a nozzle face 111*a* provided with a plurality of nozzle arrays Na to Nd each including a plurality of nozzles 111*n* that discharges liquid. The head 111 includes guide members 111*b* and 111*b* on both side portions in the nozzle arranged direction. Each guide member 111*b* is disposed not protruding from the nozzle face 111*a*, such as being flush with the nozzle face 111*a* or having a minute step to the nozzle face 111*a*. The nozzle face 111*a* and the surfaces of the guide members 111*b* are included in the object to be wiped.

The wiping device 1 includes a wiping unit 30 retained on a main frame adjusted and supported by the main body of the liquid discharge apparatus, the wiping unit 30 being capable of reciprocating in a wiping direction.

Side plates 3 and 3 of the wiping unit 30 retain a feeding roller 5 and a winding roller 6, the feeding roller 5 being a core member of a feeding roll 4A including a web 4 as a first wiping member having a belt shape, the web 4 being rolled up, the winding roller 6 being a core member of a winding roll 4B including the web 4 reeled out from the feeding roll 4A, the web 4 being wound up. Note that the feeding direction of the web 4 is identical to the direction of an arrow A.

The side plates 3 retain guide rollers 7 and 8 rotatably. A press member 9 that presses the web 4 against the nozzle face 111*a* or the surface of the guide member 111*b* included in the object to be wiped, is disposed between the guide rollers 7 and 8. For performance of a wiping operation, a spring 10 presses the press member 9 against the nozzle face 111*a* or the surface of the guide member 111*b*, with predetermined pressing force.

Preferably, the web 4 includes a sheet material having absorbency, at least having resistance to a liquid to be used, but not fluffing or not causing dust. Examples of the web 4 include nonwoven fabric, film, and paper.

The winding roller 6 receives the driving force of a drive motor 11 through a transmission mechanism 12 including a gear train.

A code wheel 13 is attached to the guide roller 7, and an encoder sensor 14 including a transmissive photosensor detects a pattern on the code wheel 13. The code wheel 13 and the encoder sensor 14 are included in an encoder 15 that detects the distance of movement of the web 4 (the amount of feeding).

A wiper 24 including a blade-shaped second wiping member, is disposed on the upstream side in a first wiping direction (direction of an arrow Y1) with respect to the web 4. The wiper 24 is retained by a wiper holder 23 retained by the side plates 3 through a shaft 25, the wiper holder 23 being capable of turning.

When the wiper holder 23 pivots (rotates), the wiper 24 pivots between a first position (home position) indicated with solid lines, a second position indicated with broken lines, and a third position indicated with virtual lines.

Here, the first position allows the wiper 24 to wipe the nozzle face 111*a*. The second position allows the web 4 to clean the wiper 24 in contact with the web 4. The third position is an evacuation position at which the wiper 24 is not in contact with the nozzle face 111*a* and the web 4.

The web 4, the feeding roller 5, the winding roller 6, the guide rollers 7 and 8, the press member 9, and the wiper 24 retained by the side plates 3 and 3, are unitized as the wiping unit 30 in a form of a cartridge, so as to be detachably mounted on the main body side.

The wiping unit 30 is disposed being capable of reciprocating in the direction of arrows Y identical to the nozzle arranged direction of the head 111. The reciprocation of the wiping unit 30 can be achieved by, for example, a movement mechanism including a rack 31, a pinion 32, and a moving motor 33 that rotates the pinion 32 or a movement mechanism including a timing belt and pulleys.

The wiping unit 30 is disposed being capable of moving (lifting and lowering) in the direction indicated by arrow Z in which the web 4 moves forward and backward with respect to the nozzle face 111*a*, namely, in the up-and-down direction. The lifting and lowering of the wiping unit 30 can be achieved by, for example, an elevation mechanism including a cam 35 and an elevation motor 36 that rotates the cam 35 or the elevation mechanism including a rack and a pinion. At this time, the reciprocation mechanism of the wiping unit 30 moves upward and downward, simultaneously with the lifting and lowering.

Figure 5:
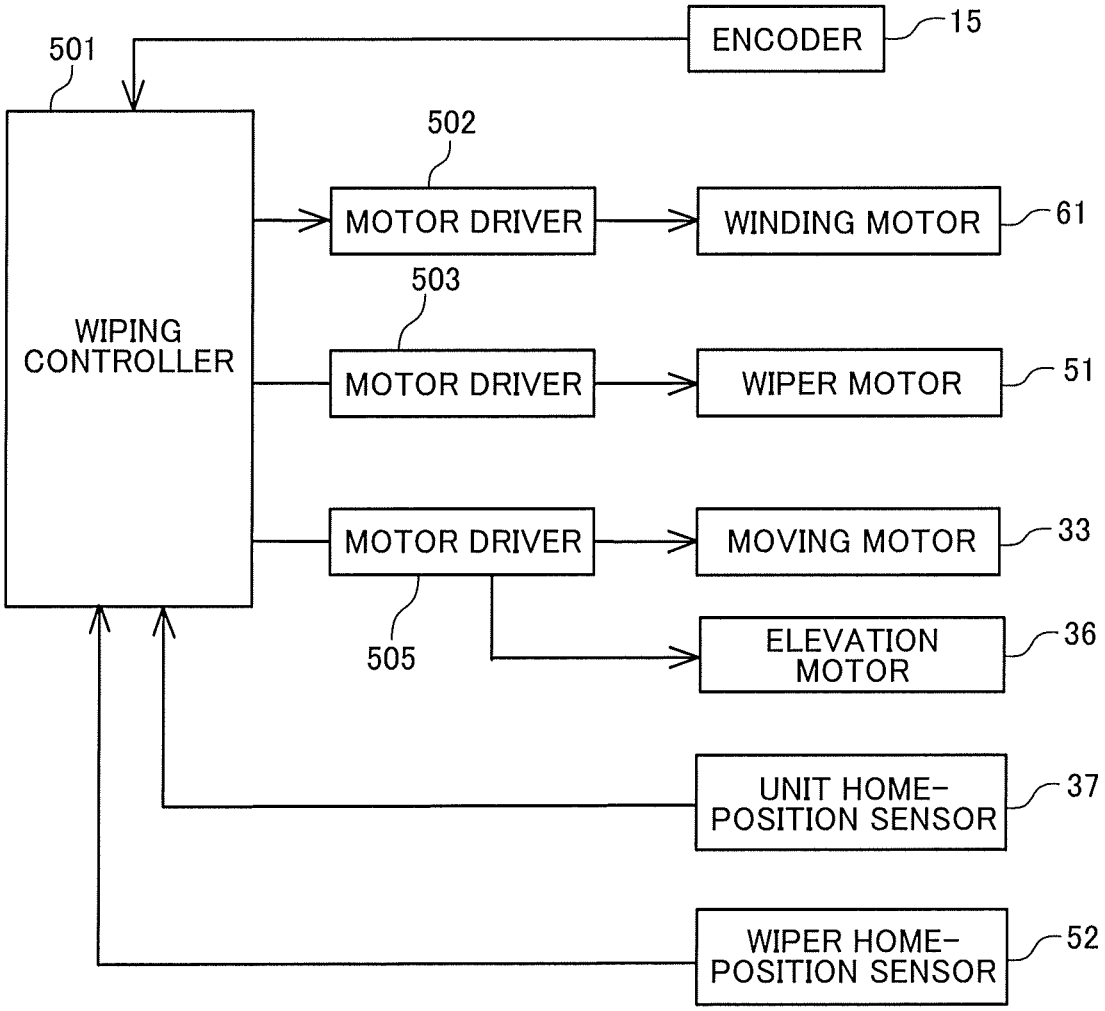
FIG. 5 is an explanatory block diagram of parts according to the control of a wiping operation in the wiping device.

Next, parts according to the control of a wiping operation in the wiping device 1, will be described referring to the explanatory block diagram of FIG. 5.

A wiping controller 501 that manages the control of the wiping device 1, can be provided, for example, as part of a controller of the liquid discharge apparatus equipped with the wiping device 1.

The wiping controller 501 controls a motor driver 502 to drive a winding motor 61 that drives the winding roller 6 to rotate. In this case, the wiping controller 501 counts the number of output pulses of the encoder 15, detects an amount of winding and an amount of rewinding of the web 4, and controls the driving of the winding motor 61.

The wiping controller 501 controls a motor driver 503 to drive a wiper motor 51 to rotate the wiper holder 23. Thus, the wiper 24 pivots to the first position, the second position, or the third position. The wiper motor 51 includes a stepping motor, and the amount of pivoting of the wiper 24 is controlled with the number of pulses.

The wiping controller 501 controls a motor driver 505 to drive the moving motor 33 and the elevation motor 36 to control the wiping unit 30 to elevate to the wiping position and to control the wiping unit 30 to relatively move in the wiping direction with respect to the nozzle face 111*a*.

The wiping controller 501 inputs respective detected results of a unit home-position sensor 37 that detects the home position of the wiping unit 30 and a wiper home-position sensor 52 that detects the home position of the wiper 24.

Functions executed by the wiping controller 501 may be implemented by one or more processing circuits or circuitry. Processing circuitry includes a programmed processor, as a processor includes circuitry. A processing circuit also includes devices such as the central processing unit (CPU), an application specific integrated circuit (ASIC), digital signal processor (DSP), field programmable gate array (FPGA), and conventional circuit components arranged to perform the recited functions.

Next, the control of a wiping operation of the wiping controller, will be described referring to FIGS. 6 to 11. FIGS. 6 to 11 are explanatory side views for describing the control of the wiping operation.

It is assumed that liquid (liquid waste) 300 has adhered to the nozzle face 111*a* of the head 111 due to a maintenance operation.

Figure 6:
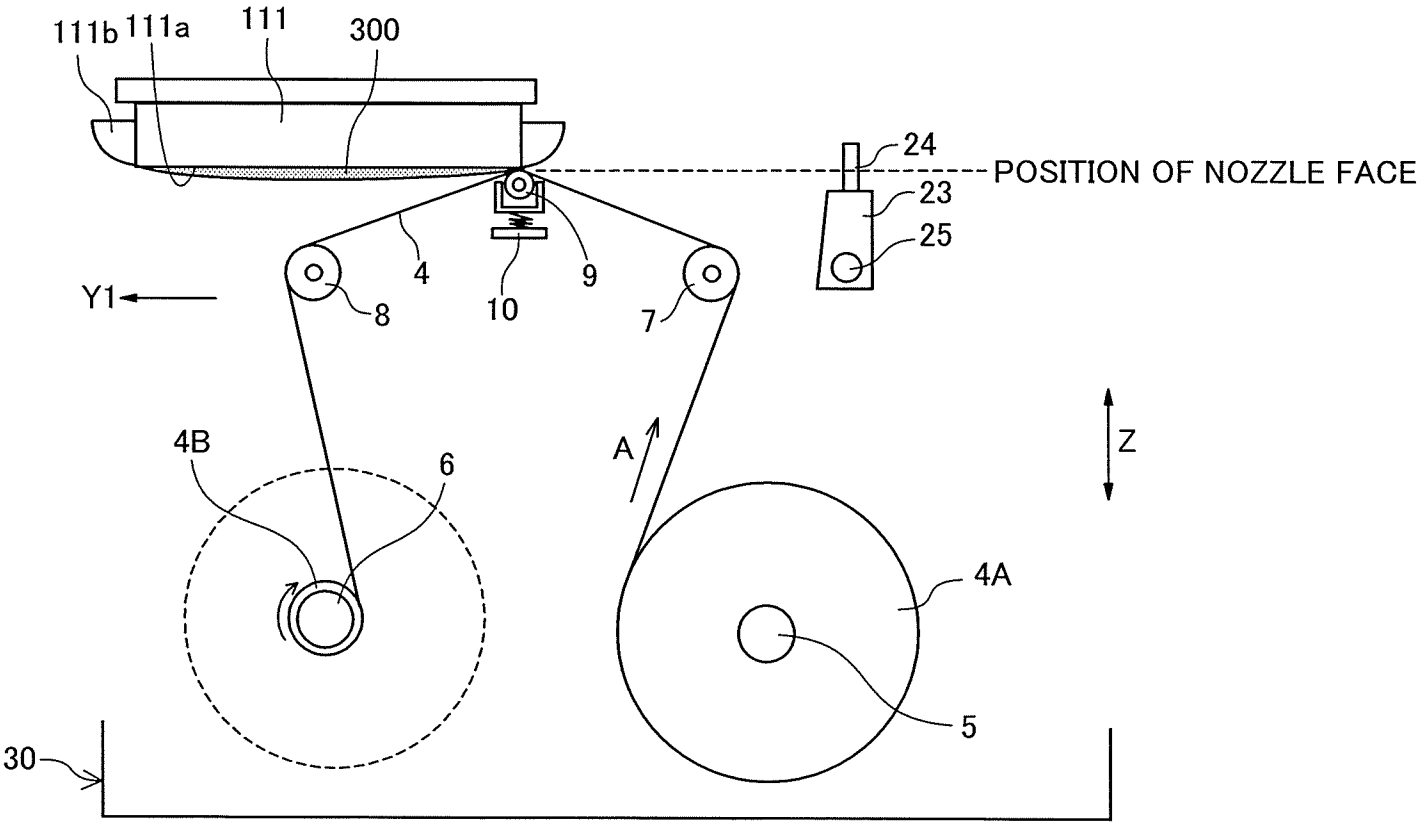
FIG. 6 is an explanatory side view for describing the control of a first wiping operation of a wiping controller.

As illustrated in FIG. 6, the wiping unit 30 lifts to a position of the nozzle face 111*a* at which the web 4 and the wiper 24 can wipe the nozzle face 111*a* (wiping start position). Then, the wiping unit 30 moves horizontally in the wiping direction Y1 that is the first direction from a wiping start side of the object to be wiped (nozzle face 111*a* and the guide member 111*b*).

Figure 7:
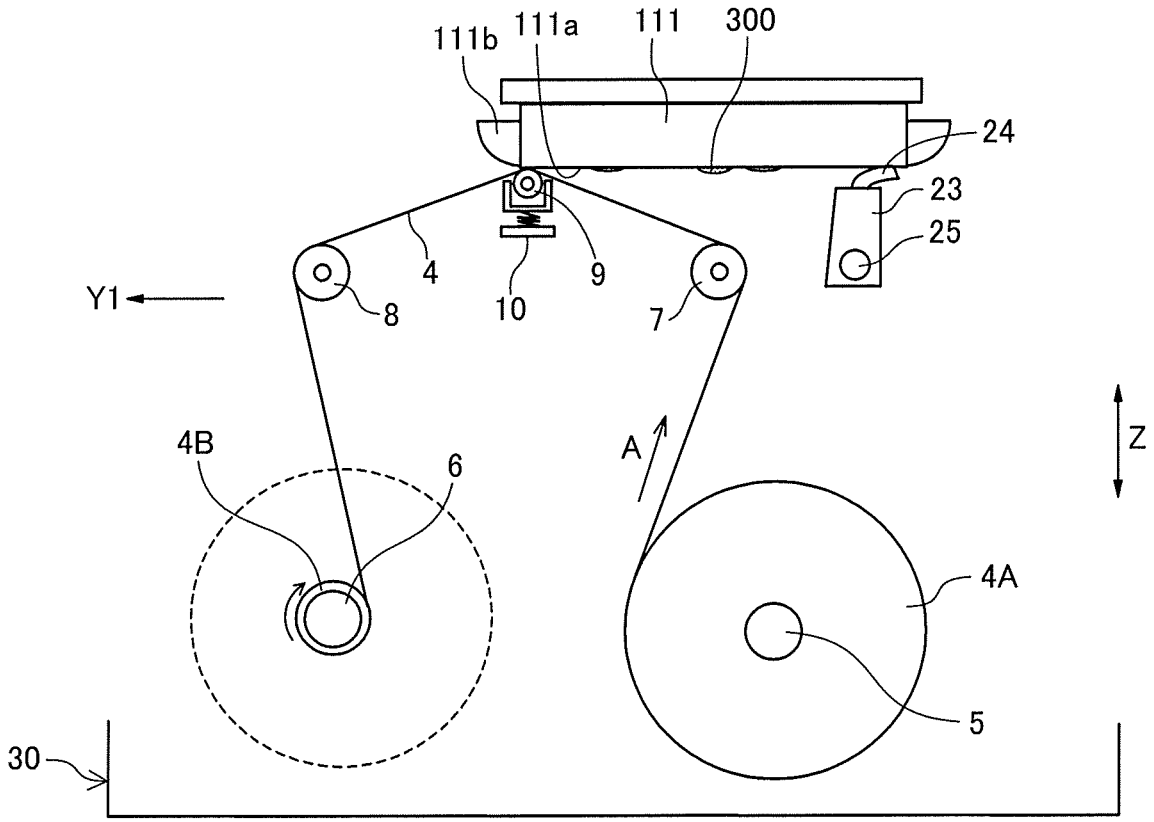
FIG. 7 is an explanatory side view for describing the control of the first wiping operation of the wiping controller, following FIG. 6.

This arrangement allows, as illustrated in FIG. 7, the web 4 to wipe the nozzle face 111*a* and the following wiper 24 to wipe the nozzle face 111*a*, so that a first wiping operation of wiping the entire region of the nozzle face 111*a* is performed.

Figure 8:
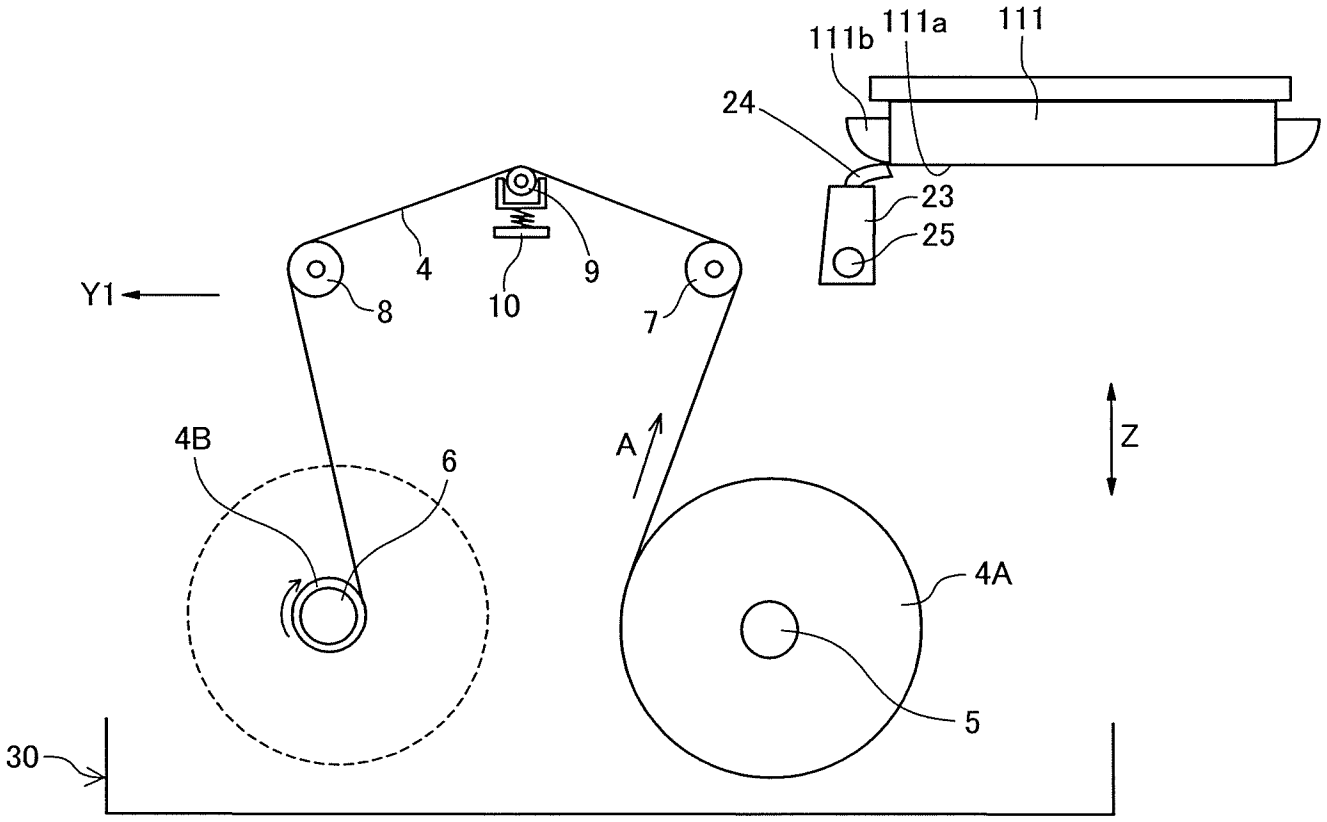
FIG. 8 is an explanatory side view for describing the control of the first wiping operation of the wiping controller, following FIG. 7.

A wiping completion position when the entire region of the nozzle face 111*a* is wiped in the first wiping operation, is, as illustrated in FIG. 8, a position at which the wiper 24 reaches the end portion in the wiping direction Y1 of the nozzle face 111*a*. At the wiping completion position, the web 4 is spaced apart from the nozzle face 111*a*, completely.

Figure 9:
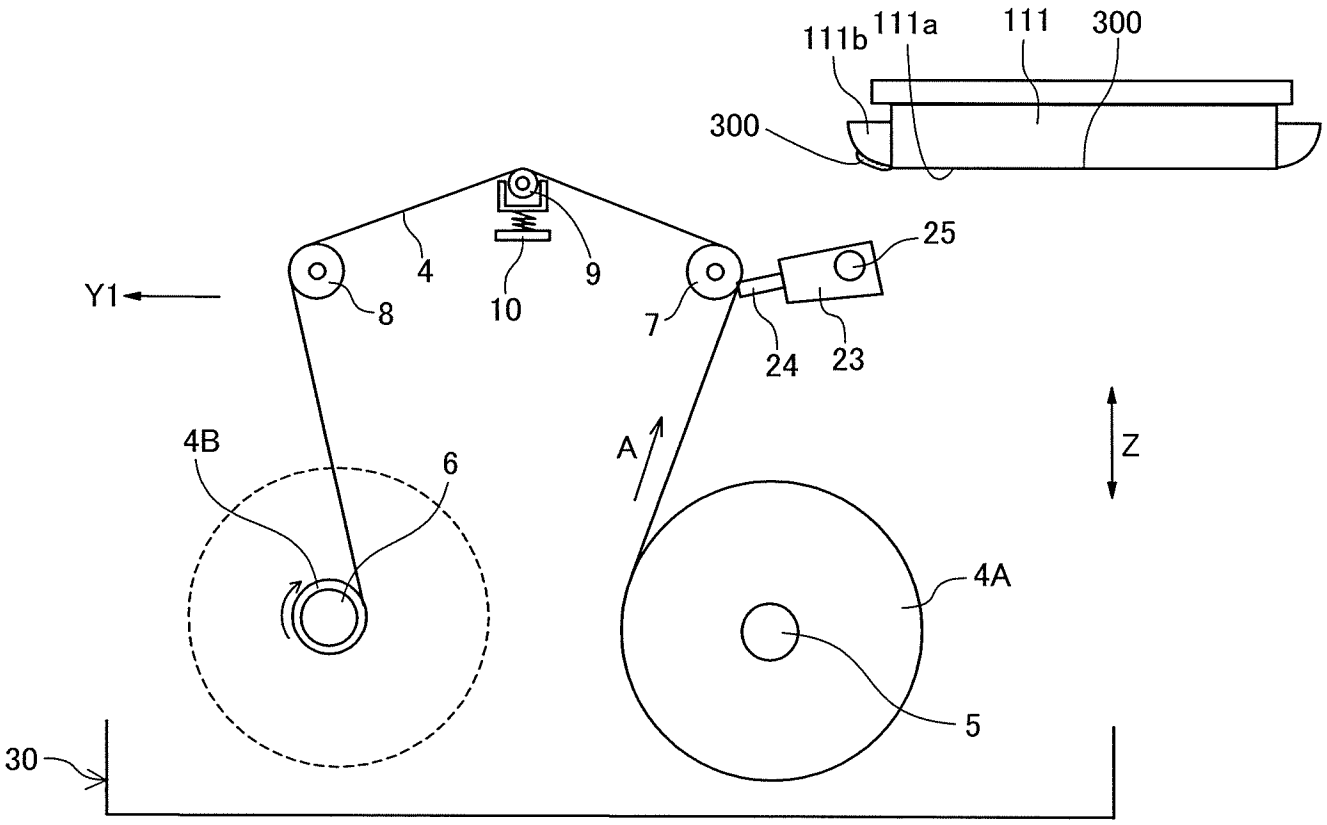
FIG. 9 is an explanatory side view for describing the control of a wiper cleaning operation of the wiping controller.

At this time, because the liquid waste 300 removed from the nozzle face 111*a* has adhered to the wiper 24, as illustrated in FIG. 9, the wiper 24 pivots to the second position so as to be in contact with the web 4, and the web 4 cleans the wiper 24.

A minute amount of liquid waste 300 may adhere to the guide member 111*b* on the downstream side in the wiping direction of the head 111 that is the portion on the wiping finish side of the object to be wiped. The liquid waste 300 adhere to the guide member 111*b* on the downstream side in the wiping direction of the head 111 includes the liquid waste 300 transferred to the wiper 24 when the wiper 24 pivots to the second position and the liquid waste 300 overflowing in the wiping direction Y1 from the nozzle face 111*a* when the wiper 24 wipes off the liquid waste 300.

Figure 10:
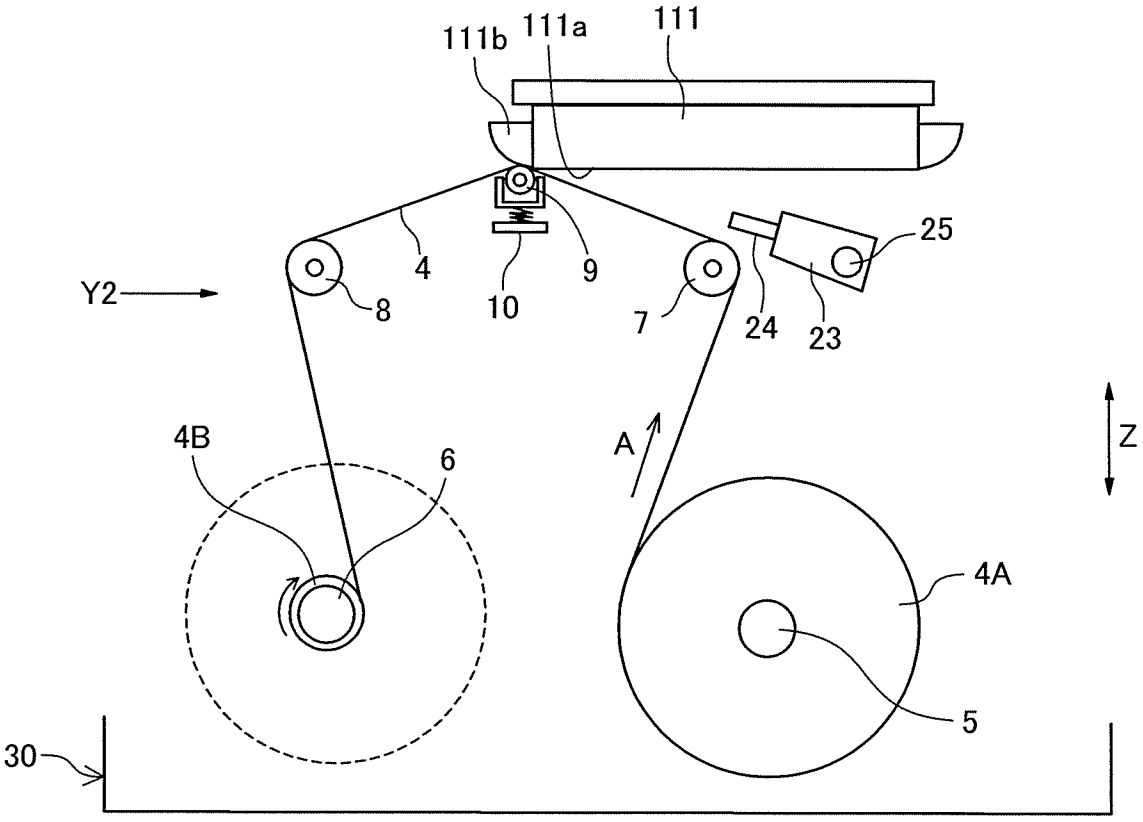
FIG. 10 is an explanatory side view for describing the control of a second wiping operation of the wiping controller.

In order to remove the liquid waste 300 adhering to the guide member 111*b* on the downstream side in the wiping direction of the head 111, as illustrated in FIG. 10, the wiping unit 30 moves in a second direction Y2 opposite to the wiping direction Y1 that is the first direction such that the web 4 is in contact with the guide member 111*b*.

Figure 11:
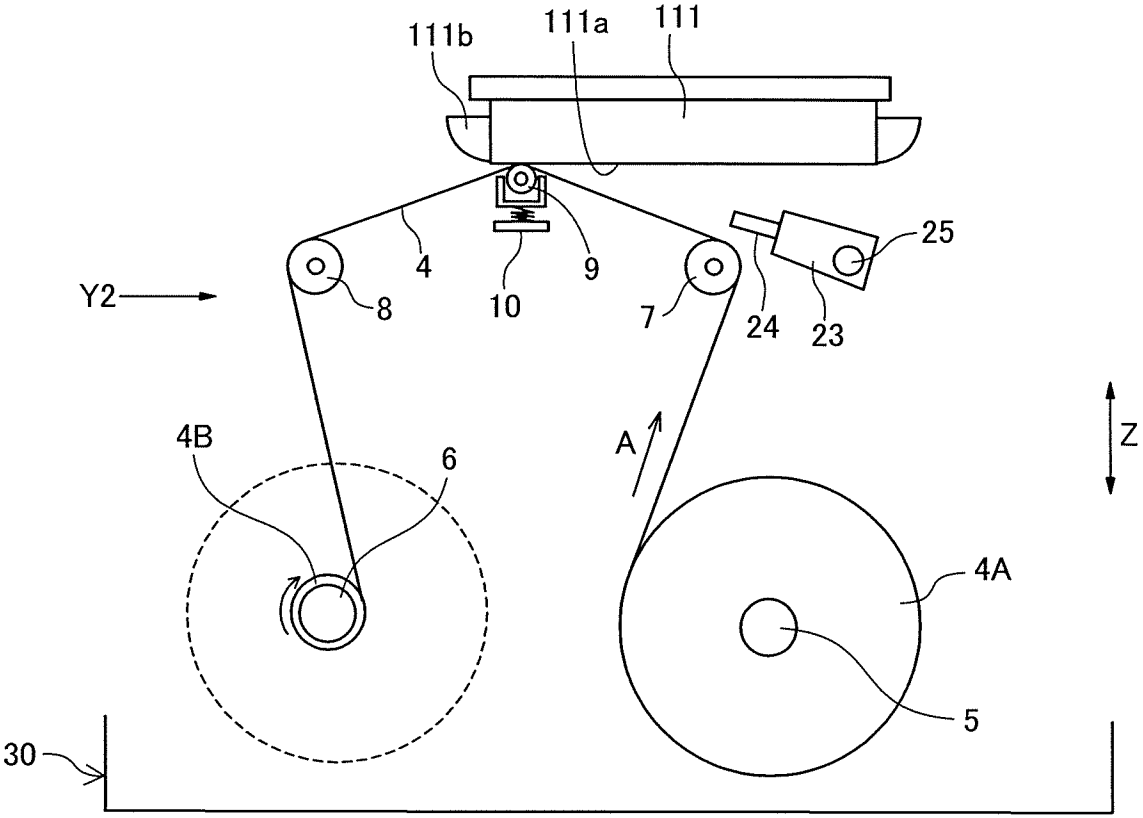
FIG. 11 is an explanatory side view for describing the control of the second wiping operation of the wiping controller, following FIG. 10.

Then, as illustrated in FIG. 11, the wiping unit 30 further moves in the second direction Y2, and a second wiping operation of wiping the nozzle face 111*a* with the web 4, is performed before the nozzle arrays Na to Nd are reached. That is, in the second wiping operation, the web 4 wipes a predetermined region on the wiping finish side of the first wiping operation (here, a region from the guide member 111*b* before the nozzle arrays).

This arrangement enables removal of the liquid waste 300 adhering to the surface of the guide member 111*b*.

Thus, the wiping device 1 includes a first wiping member including the web 4 to wipe an object to be wiped (the nozzle face 111*a* and the guide member 111*b*), and circuitry (wiping controller 501) to cause the first wiping member (web 4) to perform a wiping operation to wipe the object to be wiped (the nozzle face 111*a* and the guide member 111*b*).

The circuitry (wiping controller 501) causes the first wiping member (web 4) to perform a first wiping operation to move the first wiping member (web 4) relative to the object to be wiped (the nozzle face 111*a* and the guide member 111*b*) in a first direction (Y1) to wipe the object to be wiped (the nozzle face 111*a* and the guide member 111*b*) from a wiping start side of the first wiping operation.

The circuitry (wiping controller 501) further causes the first wiping member (web 4) to perform a second wiping operation to relatively move the first wiping member (web 4) relative to the object to be wiped (the nozzle face 111*a* and the guide member 111*b*) in a second direction (Y2) different from the first direction (Y1), to wipe the object to be wiped (the nozzle face 111*a* and the guide member 111*b*) from a wiping finish side different from the wiping start side of the first wiping operation with the first wiping member (web 4).

For the removal of liquid waste with the web 4, because the web 4 absorbs liquid easily, the liquid waste can be removed with the web 4 in contact with the nozzle face 111*a*. Therefore, the bare minimum region (outside the discharge region) is sufficient to wipe.

Note that, at this time, locating the wiper 24 at the second position or the third position, allows the wiper 24 to be not in contact with the nozzle face 111*a*, so that the wiper 24 has no influence on the wiping. Rendering the amount of movement in the opposite direction (direction Y2) to the bare minimum, enables wiping time to shorten.

In the embodiment, before the web 4 starts to wipe the nozzle face 111*a* in the first operation, a cleaning liquid can be applied to the web 4. The cleaning liquid may be dropped onto the press member 9 to apply the cleaning liquid to the web 4, for example. Thus, the press member 9 serves as an applicator to apply the cleaning liquid to the web 4. This arrangement enables more reliable performance of the absorption and removal of the liquid waste 300.

When the web 4 comes in contact with the guide member 111*b* in the second operation, the web 4 can stop moving for a predetermined period of time until the wiping unit 30 starts to move in the opposite direction (direction Y2). Thus, the second wiping operation may hold the first wiping member (web 4) in contact with the object to be wiped (guide member 111*b*) for a predetermined period of time as illustrated in FIG. 10. Furthermore, a stamping operation of causing the web 4 to contact with the guide member 111*b* a plurality of times (up-and-down movements) can be performed.

In the second operation, the amount of wiping movement in the reverse direction of the web 4 can be set arbitrarily.

Because the amount of liquid waste that adheres to the guide member 111*b* is minute, the second operation is not necessarily performed every first operation. After the first operation is performed a predetermined number of times, the second operation can be performed. This arrangement can inhibit the duration of a usual wiping operation from lengthening.

Note that, the example in which the second wiping member is provided has been given in the embodiment, but the first wiping member can be provided without the second wiping member. The example in which the guide members 111*b* are provided on both sides in the wiping direction has been given in the embodiment, but no guide members 111*b* can be provided.

Figure 12:
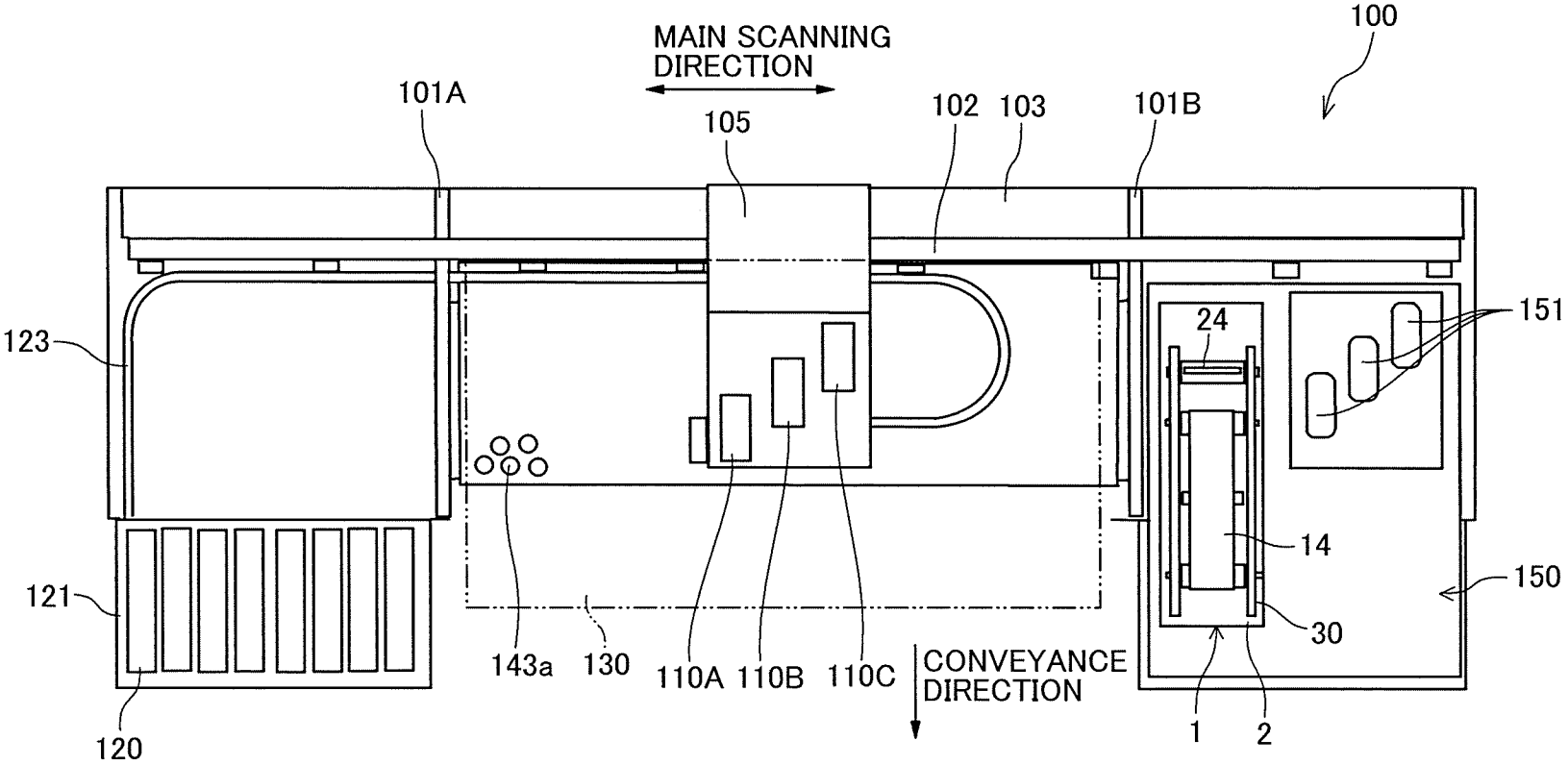
FIG. 12 is an explanatory plan view of a machine of an exemplary liquid discharge apparatus according to the present disclosure.
Figure 13:
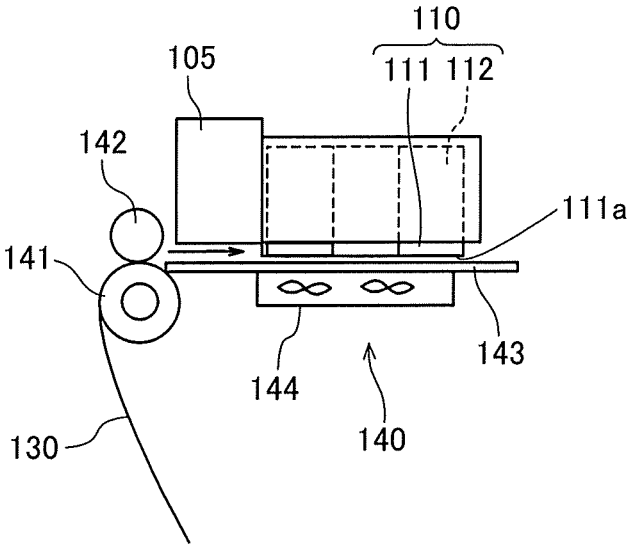
FIG. 13 is an explanatory side view of a main part of the liquid discharge apparatus according to the present disclosure.

Next, an exemplary liquid discharge apparatus according to the present disclosure, will be described referring to FIGS. 12 and 13. FIG. 12 is an explanatory plan view of a machine of the liquid discharge apparatus. FIG. 13 is an explanatory side view of a main part of the liquid discharge apparatus.

A liquid discharge apparatus 100 includes a serial head apparatus. A guide mechanism including a main guide member 102 bridged across a left side plate 101A and a right side plate 101B, and a sub-guide plate 103, retains a carriage 105 movably in a main scanning direction.

The carriage 105 is equipped with three liquid discharge units 110 (110*a* to 110*c*). Each liquid discharge unit 110 includes the head 111 and a sub-tank 112, integrally, the head 111 serving as a liquid discharger, the sub-tank 112 supplying liquid to the head 111.

A cartridge holder 121 is disposed on the main body side, the cartridge holder 121 holds a plurality of main tanks 120 housing liquids for colors. The main tanks 120 are detachably attached to the cartridge holder 121. The main tanks 120 serves as liquid cartridges. The respective heads 111 of the liquid discharge units 110 are supplied with the liquids for the colors from the main tanks 120 attached to the cartridge holder 121 through a liquid channel 123 including supply tubes for the colors, by a liquid feeding pump.

Meanwhile, in order to convey a sheet material 130 in a conveyance direction, provided is a conveyor 140 that sucks the sheet material 130 and then conveys the sheet material 130 opposed to the heads 111.

The conveyor 140 includes: a conveyance roller 141; a pressing roller 142 pressed in contact with the conveyance roller 141; a platen member 143 opposed to the heads 111; and a suction machine 144 that sucks the sheet material 130 through suction holes 143*a* of the platen member 143. Note that, although the suction holes 143*a* are partially illustrated in the figure, the suction holes 143*a* are disposed over the platen member 143.

A maintenance mechanism 150 that maintains the heads 111, is disposed on one side in the main scanning direction of the carriage 105.

The maintenance mechanism 150 that is a head maintenance device according to the present disclosure, includes, for example, caps 151 that cap the nozzle faces 111*a* of the heads 111 and the wiping unit 30 of the wiping device 1 that wipes the nozzle faces 111*a*, according to the present disclosure. The wiping unit 30 is disposed on a main frame 2.

The liquid discharge apparatus 100 conveys the sheet material 130 in the conveyance direction with the conveyance roller 141 and the pressing roller 142, the sheet material 130 being sucked on the platen member 143.

Thus, the heads 111 are driven in accordance with a printing signal while the carriage 105 is moving in the main scanning direction. Then, the liquid for a required color is discharged onto the sheet material 130 stopping, and printing is performed by one line. Printing for the next line after the sheet material 130 is conveyed by a predetermined amount, is repeatedly performed. Then, the sheet material 130 is ejected.

In the present application, liquid to be discharged is not limited in particular as long as the liquid has a viscosity or surface tension allowing the liquid to be discharged from the head. Preferably, the viscosity is not greater than 30 mPa·s under ordinary temperature and ordinary pressure or by heating or cooling. More specifically, examples of the liquid include a solution, a suspension, and an emulsion that contain a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for inkjet ink, surface treatment solution, a liquid for forming constituent elements of electronic element or light-emitting element or a resist pattern of electronic circuit, or a material solution for three-dimensional fabrication.

Examples of an energy generation source for discharging the liquid include a piezoelectric actuator (a laminated piezoelectric element or a thin-film piezoelectric element), a thermal actuator that employs an electrothermal conversion element, such as a heating resistor, and an electrostatic actuator including a diaphragm and opposed electrodes.

The "liquid discharge unit" includes the liquid discharge head integrated with a functional component or mechanism. An example of the "liquid discharge unit" is an assembly of parts relating to liquid discharge. For example, the "liquid discharge unit" includes a combination of the liquid discharge head with at least one of a head tank, a carriage, a supply mechanism, a maintenance mechanism, and a main scanning movement mechanism.

Here, examples of the integration include mutually securing of the liquid discharge head and the functional component or mechanism through fastening, bonding, or engaging, and movably retention of one to the other. The liquid discharge head and the functional component or mechanism may be provided mutually detachably.

For example, as the liquid discharge unit, provided is the integration of the liquid discharge head with the head tank. For the integration, the liquid discharge head and the head tank are coupled mutually through a tube. Here, a unit including a filter can be added between the head tank and the liquid discharge head of the liquid discharge unit.

As the liquid discharge unit, provided is the integration of the liquid discharge head with the carriage.

As the liquid discharge unit, provided is the integration of the liquid discharge head with the main scanning movement mechanism, in which the liquid discharge head is retained movably by a guide member included in part of the main scanning movement mechanism. Provided is the integration of the liquid discharge head, the carriage, and the main scanning movement mechanism.

As the liquid discharge unit, provided is the integration of the liquid discharge head, the carriage, and the maintenance mechanism, in which a cap member included in part of the maintenance mechanism is secured to the carriage having the liquid discharge head attached.

As the liquid discharge unit, provided is the integration of the liquid discharge head and the supply mechanism, in which a tube is coupled to the liquid discharge head having the head tank or a channel component attached. Through the tube, the liquid in a liquid storage source is supplied to the liquid discharge head.

The main scanning movement mechanism includes the guide member as a single body. The supply mechanism includes the tube as a single body and a loader as a single body.

An example of the "liquid discharge apparatus" is an apparatus including the liquid discharge head or the liquid discharge unit, the apparatus being to drive the liquid discharge head to discharge the liquid. Examples of the liquid discharge apparatus include an apparatus capable of discharging liquid to an object to which the liquid can adhere, and an apparatus that discharges liquid into gas or liquid.

The "liquid discharge apparatus" can include not only units involved in feeding, conveyance, and paper ejection of the object to which liquid can adhere, but also a preprocessing device and a postprocessing device.

Examples of the "liquid discharge apparatus" include: an image forming apparatus that discharges ink to form an image on a paper sheet; and a solid fabrication apparatus (three-dimensional fabrication apparatus) that discharges a fabrication liquid to a powder layer including powder formed in layers in order to shape a solid shaped object (three-dimensional fabrication object).

The "liquid discharge apparatus" is not limited to visualization of a meaningful image including a character or a figure, with the discharged liquid. For example, formation of a pattern having no meaning and shaping of the pattern to a three-dimensional image, are included.

The "object to which liquid can adhere" described above means an object to which liquid can adhere at least temporarily, the liquid being to adhere to and to fix on the object or to adhere to and to permeate the object. Specific examples include recording media, such as a paper sheet, recording paper, a recording paper sheet, film, and cloth, electronic components, such as an electronic substrate and a piezoelectric element, and media, such as a powder layer (granular layer), an organ model, and a testing cell. Unless otherwise limited in particular, any object to which liquid adheres, is included.

The material of the "object to which liquid can adhere" may be any material, such as paper, thread, fiber, fabric cloth, leather, metal, plastic, glass, wood, or ceramics as long as liquid can adhere to at least temporarily.

The "liquid discharge apparatus" may be, but is not limited to, an apparatus that relatively moves the liquid discharge head and the object to which liquid can adhere. Specific examples include a serial head apparatus that moves the liquid discharge head and a line head apparatus that does not move the liquid discharge head.

Further examples of the "liquid discharge apparatus" include a treatment liquid coating apparatus that discharges a treatment liquid onto a paper sheet in order to coat the treatment liquid on the surface of the paper sheet for reforming of the surface of the paper sheet, and an injection granulation apparatus that sprays a composition liquid including raw material dispersed in a solution, through a nozzle, to granulate fine particles of the raw material.

Note that the terms "image formation", "recording", "character printing", "image printing", "printing", and "shaping" are used as a synonym in the present application.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A wiping device comprising:

a wiping member including a web to wipe an object to be wiped;

another wiping member including a blade to wipe the object to be wiped; and circuitry to cause the wiping member to perform a wiping operation to wipe the object to be wiped, wherein the circuitry causes the wiping member to:

perform a first wiping operation to move the wiping member relative to the object to be wiped in a first direction to wipe the object to be wiped from a wiping start side of the first wiping operation;

perform a second wiping operation to relatively move the wiping member relative to the object to be wiped in a second direction different from the first direction, to wipe the object to be wiped from a wiping finish side different from the wiping start side of the first wiping operation with the wiping member; and cause the another wiping member to move to a wiping position in the first wiping operation, and move to an evacuation position in the second wiping operation.

2. The wiping device according to claim 1, wherein said another wiping member is movable between the wiping position, which is a position at which said another wiping member is in contact with the object to be wiped to wipe the object to be wiped and the evacuation position, which is a position at which said another wiping member is not in contact with the object to be wiped.

3. The wiping device according to claim 1, further comprising an applicator to apply a cleaning liquid to the wiping member.

4. The wiping device according to claim 1, wherein the circuitry causes the wiping member to perform the second wiping operation after performing the first wiping operation a predetermined number of times.

5. The wiping device according to claim 1, wherein the second wiping operation holds the wiping member in contact with the object to be wiped for a predetermined period of time.

6. The wiping device according to claim 1, wherein the circuitry causes the wiping member to wipe a nozzle face of a liquid discharge head to discharge a liquid from nozzles formed in the nozzle face.

7. The wiping device according to claim 6, wherein the liquid discharge head includes a guide member disposed at an end portion of the liquid discharge head in at least one of the first direction and the second direction, and the circuitry causes the wiping member to wipe the guide member in the second wiping operation.

8. The wiping device according to claim 1, wherein the second direction is opposite to the first direction.

9. A head maintenance device comprising the wiping device according to claim 1 to maintain a liquid discharge head to discharge a liquid from nozzles formed in a nozzle face as the object to be wiped.

10. A liquid discharge apparatus comprising:

a liquid discharge head to discharge a liquid to discharge a liquid from nozzles formed in a nozzle face; and the wiping device according to claim 1 to wipe the nozzle face of the liquid discharge head as the object to be wiped.

* * * * *